US007012542B2

(12) United States Patent
Powell et al.

(10) Patent No.: US 7,012,542 B2
(45) Date of Patent: Mar. 14, 2006

(54) MULTICOLOR FUNCTION INDICATOR LIGHT

(75) Inventors: Mark H. Powell, Marina Del Rey, CA (US); David W. Seaton, Hermosa Beach, CA (US); Eric Mendenhall, Dove Canyon, CA (US)

(73) Assignee: Gibson Guitar Corp., Nashville, TN (US)

( * ) Notice: Subject to any disclaimer, the term of this patent is extended or adjusted under 35 U.S.C. 154(b) by 222 days.

(21) Appl. No.: 10/407,817

(22) Filed: Apr. 4, 2003

(65) Prior Publication Data

US 2004/0070513 A1 Apr. 15, 2004

Related U.S. Application Data

(60) Provisional application No. 60/370,289, filed on Apr. 5, 2002.

(51) Int. Cl.
*G09F 9/00* (2006.01)

(52) U.S. Cl. ..... 340/815.44; 340/815.4; 340/815.43; 340/815.65

(58) Field of Classification Search ..... 340/815.44, 340/815.65–815.68, 815.45, 691.6, 815.73–815.76, 340/815.43; 330/2
See application file for complete search history.

(56) References Cited

U.S. PATENT DOCUMENTS 3,568,177 A * 3/1971 Hasler ..... 345/697
3,863,246 A * 1/1975 Trcka et al. ..... 345/102
3,891,933 A * 6/1975 Suzuki et al. ..... 330/2
3,953,806 A * 4/1976 Veranth ..... 330/2
4,000,475 A * 12/1976 Oiwa ..... 330/66
4,048,573 A * 9/1977 Evans et al. ..... 330/2
4,355,348 A 10/1982 Williams ..... 362/86
4,812,814 A * 3/1989 Elliott ..... 340/332
4,972,305 A 11/1990 Blackburn ..... 362/234
5,191,319 A 3/1993 Kiltz ..... 340/701
5,365,219 A 11/1994 Wong et al. ..... 340/573
5,396,350 A * 3/1995 Beeson et al. ..... 349/62
5,486,843 A * 1/1996 Otting et al. ..... 345/35
5,501,131 A 3/1996 Hata ..... 84/464
5,847,610 A * 12/1998 Fujita ..... 330/298
5,861,815 A 1/1999 Wernig ..... 340/815.7
5,961,201 A 10/1999 Gismondi ..... 362/233
6,255,786 B1 7/2001 Yen ..... 315/291
6,255,960 B1 7/2001 Ahne et al. ..... 340/815.4
6,257,737 B1 7/2001 Marshall et al. ..... 362/231

* cited by examiner

*Primary Examiner*—Daniel Wu
*Assistant Examiner*—Son Tang
(74) *Attorney, Agent, or Firm*—Waddey & Patterson, P.C.; Lucian Wayne Beavers

(57) ABSTRACT

A multicolor function indicator light system is provided for an audio amplifier or similar electronic equipment. A sensor circuit monitors operation of the equipment. An indicator light device has a plurality of different color outputs. A control logic circuit receives input signals from the sensor and controls the indicator light device so that different sensed modes of operation of the electronic equipment are indicated by different color outputs of the indicator light device.

18 Claims, 7 Drawing Sheets

MULTICOLOR FUNCTION INDICATOR LIGHT

This application claims the priority benefits under Title 35. United States Code, §119(e) of U.S. Provisional Application Ser. No. 60/370,289 filed on Apr. 5, 2002.

BACKGROUND OF THE INVENTION

The present invention relates generally to indicator lights for use with electronic equipment, and more particularly, but not by way of limitation, to a multicolor light indicator system for use with a power amplifier, and even more particularly, but not by way of limitation, to a multicolor light indicator system for use with an audio amplifier.

Typically, electronic equipment includes an indicator light that indicates if the equipment is powered on or powered off. The prior art has used multiple indicator lights wherein each light indicates a different function or mode of operation of the electronic equipment. For example, it is known in the arts to employ a clipping indicator light to inform an operator that an audio amplifier is operating in a mildly overdriven condition or mode and that excessive signal distortion is occurring. The prior art has also included electronic equipment having lights activated by voltage or current levels corresponding to audio volume signal levels as a decorative or amusement device.

Typically, these prior art devices employ a separate indicator light for each item of information, thus limiting the amount of information conveyed by a single indicator light. Where it is desirable to monitor multiple modes of operation, the prior art has taught devices which employ meters (typically, voltage or current meters) or that employ arrays of indicator lights. Operators of typical prior art devices must sort through multiple visual signals to determine the operating mode of the devise. This may present an operator with an overload of visual information. Such visual overload may be particularly problematic if the device is an audio amplifier. High quality professional audio amplifiers are frequently used in performance environments that restrict the operators ability to accurately discern between multiple lights and meters place on the compact control panels of the audio amplifiers.

There is a need in the art for more sophisticated and more informative indicator light systems that use a single indicator light, particularly for use with high quality professional audio equipment.

SUMMARY OF THE INVENTION

A multicolor function indicator light system for an audio amplifier includes a sensor for monitoring operation of the amplifier, an indicator light device having a plurality of different color outputs, and a control logic circuit for receiving input signals from the sensor and for controlling the indicator light device so that different sensed modes of operation of the amplifier are indicated by different color outputs of the indicator light device.

Preferably the indicator light device includes a plurality of LEDs, such as a red LED, a green LED, a yellow LED and an orange LED which may be illuminated separately or simultaneously to provide any desired color output.

The color output may be distinctly different colors corresponding to different modes of operation such as: (1) power on; (2) signal present; (3) clipping; and (4) a protection or buffering mode when extreme clipping is present. Alternatively, a spectrum of color outputs can be provided corresponding to the infinite spectrum of operative modes of the amplifier as it moves from signal present into a clipping mode and into a protecting mode.

Accordingly, it is an object of the present invention to provide an improved function indicator system for an amplifier or other electronic equipment.

Another object of the invention is the provision of a plurality of colored light outputs, each colored light output corresponding to one of the multiple operational modes of the equipment.

And another object of the present invention is the provision of such a multiple color output through a single output lens.

Other and further objects, features, and advantages of the present invention will be readily apparent to those skilled in the art upon the reading of the following disclosure when taken in conjunction with the accompanying drawings.

DESCRIPTION OF THE PREFERRED EMBODIMENTS

Figure 1:
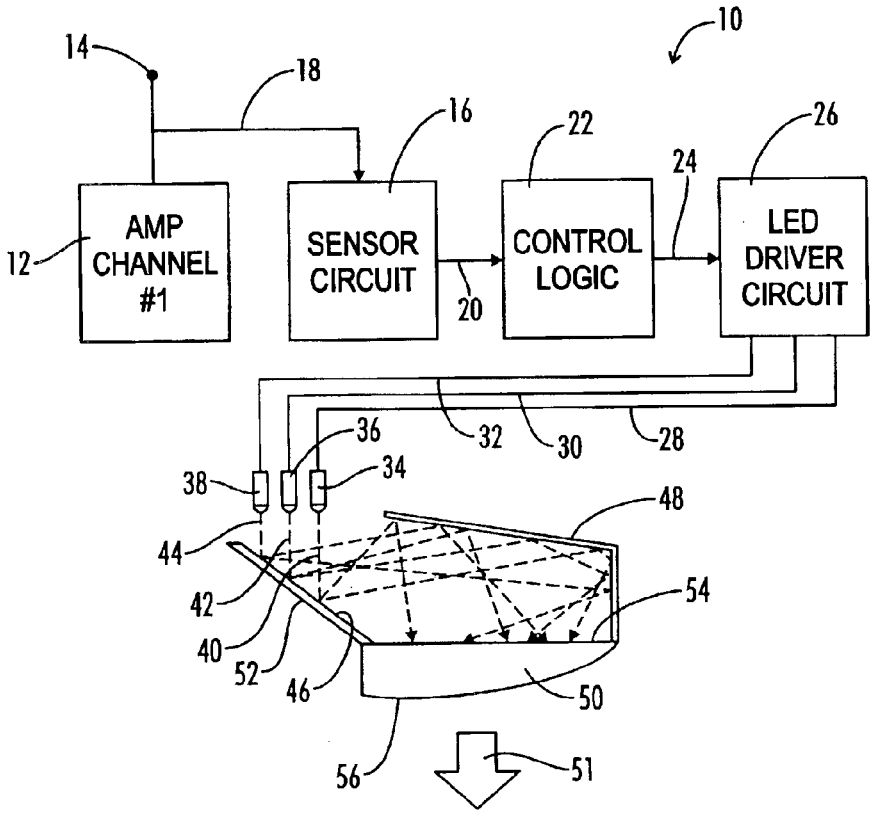
FIG. 1 is a functional schematic illustration of the multicolor function indicator system of the present invention.

Referring now to the drawings, and particularly to FIG. 1, the multicolor function indicator light system is shown and generally designated by the numeral 10.

As will be understood by those skilled in the art, any conventional amplifier system for professional audio equipment or the like will have one or more channels of amplification. In the apparatus illustrated in FIGS. 2–4 there are first and second channels of amplification each of which will have a separate amplifier and separate indicator light associated therewith. Although the present invention is drawn to an audio amplifier circuit, those skilled in the art will recognize that the multicolor function indicator light system may be used with conventional power amplifier circuits.

In FIG. 1, a first electrical circuit channel of amplification is generally designated by the numeral 12. The audio amplifier (not shown) of amplifier circuit 12 has an output 14.

A sensor circuit 16 is connected to and monitors the amplifier output 14 via electrical connection 18 and a conventional output sensor (not shown). The sensor circuit 16 has various selected conventional sensors (not shown) electrically connected to the amplifier circuit and by which the sensor circuit 16 monitors other selected amplifier circuit parameters. Those amplifier circuit parameters are selected as indicators of the operational modes of the amplifier.

Sensor circuit 16 creates an input signal corresponding to the sensed mode of operation. The input signal is communicated via electrical connection 20 to control logic circuit 22. Control logic circuit 22 may be a microprocessor based controller or any other suitable controller.

Based upon a preprogrammed logic contained in the control logic circuit 22, output control signals will be generated in response to the sensed operating mode of the amplifier. The control logic circuit 22, selectably controls a multicolor luminaire, or other polychromatic light source, such that each different sensed mode of operation of the amplifier is indicated by an output light of a different color. The color of the output light displayed is determined by a predetermined hierarchy of mode operation of the amplifier.

Referring again to FIG. 1, this embodiment employs a light emitting diode (LED) array as the multicolor light source. The control logic circuit 22 output signals are communicated via electrical connection 24 to a LED driver circuit 26. The LED driver circuit 26 will in turn communicate via electrical connections 28, 30 and 32 with a red LED 34, a green LED 36, and a blue LED 38. Although, this embodiment employs three LEDs, each emitting light of a different color, one skilled in the arts would recognize that many combinations of the number of LED's and colors may be substituted for the disclosed LED array.

The light emitted from a conventional polychromatic light source having multiple sources of single color light, such as the instant LED array, does not have a uniform color or intensity. The beams of colored light from the various individual sources are not co-linear. Although true collimation is neither desired nor necessary, it is desirable to mix the various emitted light beams and to spread the output light beam over the surface of an indicator lens, or other such devise, in order that the output light seen by an observer is of even color and intensity. Various combinations of reflective and refractive surfaces and materials are known in the arts and may be used to mix the plurality colored lights emitted by the light source.

FIG. 1 shows an embodiment of the present invention employing a reflector assembly disposed adjacent to the light source and having a plurality of reflective surfaces for receiving and reflecting the output light. Specifically, the red, green and blue LEDs 34, 36 and 38 emit colored light beams 40, 42 and 44, respectively, which reflect off a reflecting surface 46 into a diffusion box or light box 48. The reflector 46 may be a reflective foil positioned on an inner surface of a flat panel 52 which may be integrally molded with a indicator lens 50.

As schematically illustrated in FIG. 1, the beams, 40, 42 and 44, after reflecting off of reflector 46, are diffused within the diffuser box 48 so that essentially a randomly directed resultant light will impinge upon the clear indicator lens 50.

Figure 2:
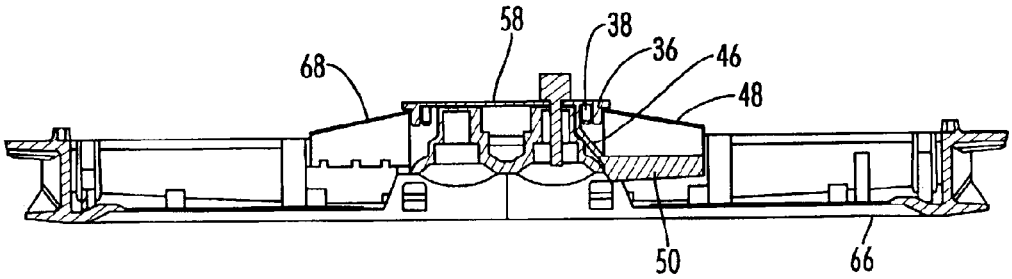
FIG. 2 is a cross sectional view of one physical embodiment of the indicator lights, the reflector, the lens housing and the lens in place within a front panel of an amplifier.
Figure 3:
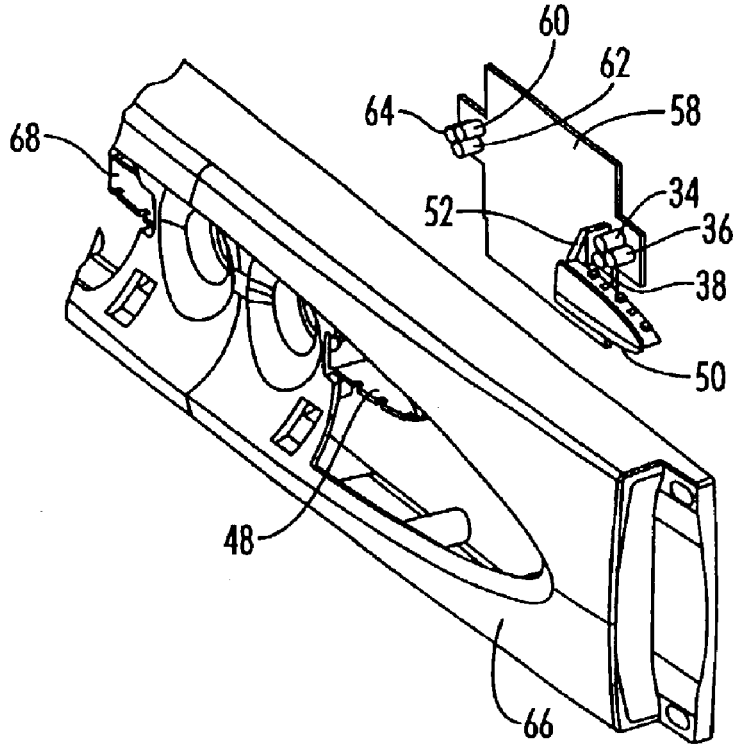
FIG. 3 is a front perspective exploded view of the apparatus of FIG. 2.

The diffuser box 48 essentially acts as a secondary reflector and as best seen in FIGS. 2 and 3, the external dimensions of the light box 48 correspond to the shape and dimensions of the indicator lens 50. The purpose of the light box 48 is to disperse the light rays evenly so as to avoid the appearance of shadows or areas of varying intensity on the indicator lens 50.

Referring again to FIG. 1, the indicator lens 50 is a clear lens molded from a material such as Acrylite, which is an acrylic having opacity particles that further disperse the light within the material. To further aid the even dispersion of light, the indicator lens 50 is frosted or textured on its inner lens surface 54 where the light from diffuser box 48 first enters the indicator lens 50. In addition, as can be seen in FIG. 1, the indicator lens 50 itself has a curved convex outer lens surface 56 to magnify the light coming through the indicator lens 50.

The indicator lens 50 directs the light output as indicated schematically at number 51 for viewing by a human user of the electronic equipment.

As best seen in FIG. 3, the three LEDs 34, 36 and 38 are attached to a mounting board 58, as is the integrally molded indicator lens 50 and panel 52.

Also visible in FIG. 3 on the left hand side of mounting board 58 are a second group of LEDs 60, 62 and 64 which would be associated with a second channel of amplification in the amplifier.

In FIG. 3 a front panel 66 of a professional audio amplifier is partially indicated in FIG. 3. As can be seen, the light box 48 is mounted on the front panel 66, and a second light box 68 is seen for mounting of the associated components corresponding to the second channel of amplification.

Figure 4:
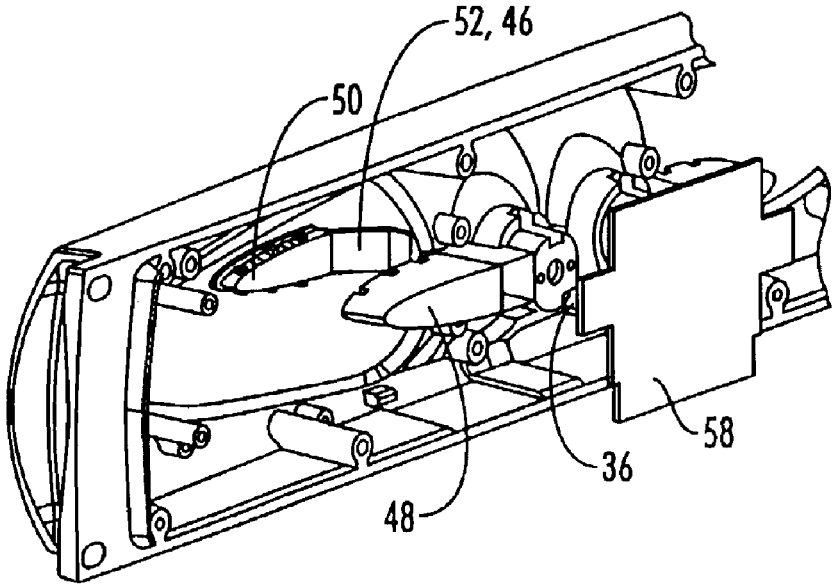
FIG. 4 is a rear perspective exploded view of the apparatus of FIG. 2.

An assembled cross-sectional view of these components is shown in FIG. 2. A rear exploded view of the components is shown in FIG. 4.

Referring again to FIG. 1, the control logic circuit 22 receives input signals from the sensor circuit 16 corresponding to the operational mode of the amplifier for controlling the LEDs 34, 36 and 38 via LED driver circuit 26 so that different sensed modes of operation of the amplifier are indicated by different color outputs of light at indicator lens 50.

In one example of the possible outputs from the multicolor function indicator light system 10, four different distinct colors can be emitted sequentially corresponding to the following four operational modes of the amplifier:

(1) power on;

(2) signal present;

(3) clipping; and (4) a protection mode.

The distinct colors corresponding to these modes could, for example, be green, yellow, orange and red, respectively. It will be understood that the selection of the particular colors corresponding to any particular function are completely arbitrary and may be selected by the designer and/or user of the equipment.

Alternatively, rather than having distinct color outputs corresponding to each of the selected modes, the control logic circuit 22 can cause a gradual change of color such as from lighter shades to darker shades and moving through the color spectrum. For example, the output could vary from cooler blue colors to hotter red colors.

Additionally, the control logic circuit 22 may be programmed to convey multiple items of information to an observer by controlling the luminaire such that a luminaire output light color may be illuminated at varying intensities or frequencies. In the embodiment shown in FIG. 1, the control logic circuit 22 may be programmed to vary the intensity or to vary the flashing rate of the output light to indicate the relative amount of distortion in the amplifier output signal while the color of the output light indicates that the amplifier output signal is present.

Figure 5A:
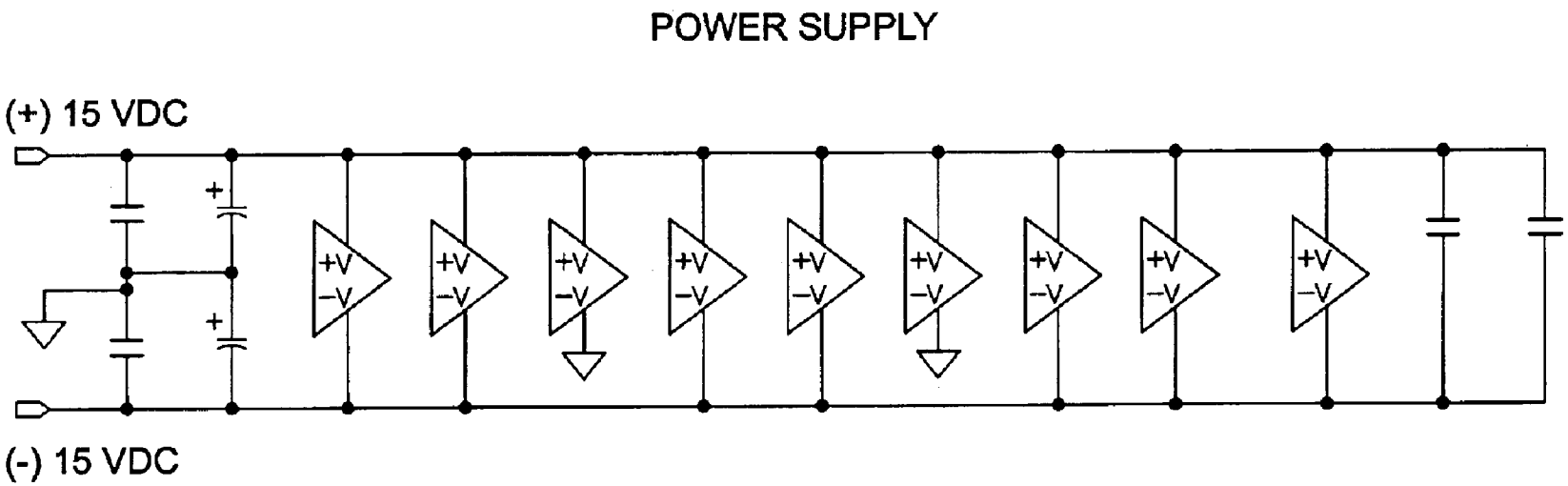
FIG. 5*a* is a schematic of the power supply of one embodiment of the apparatus of FIG. 5*d*.
Figure 5B:
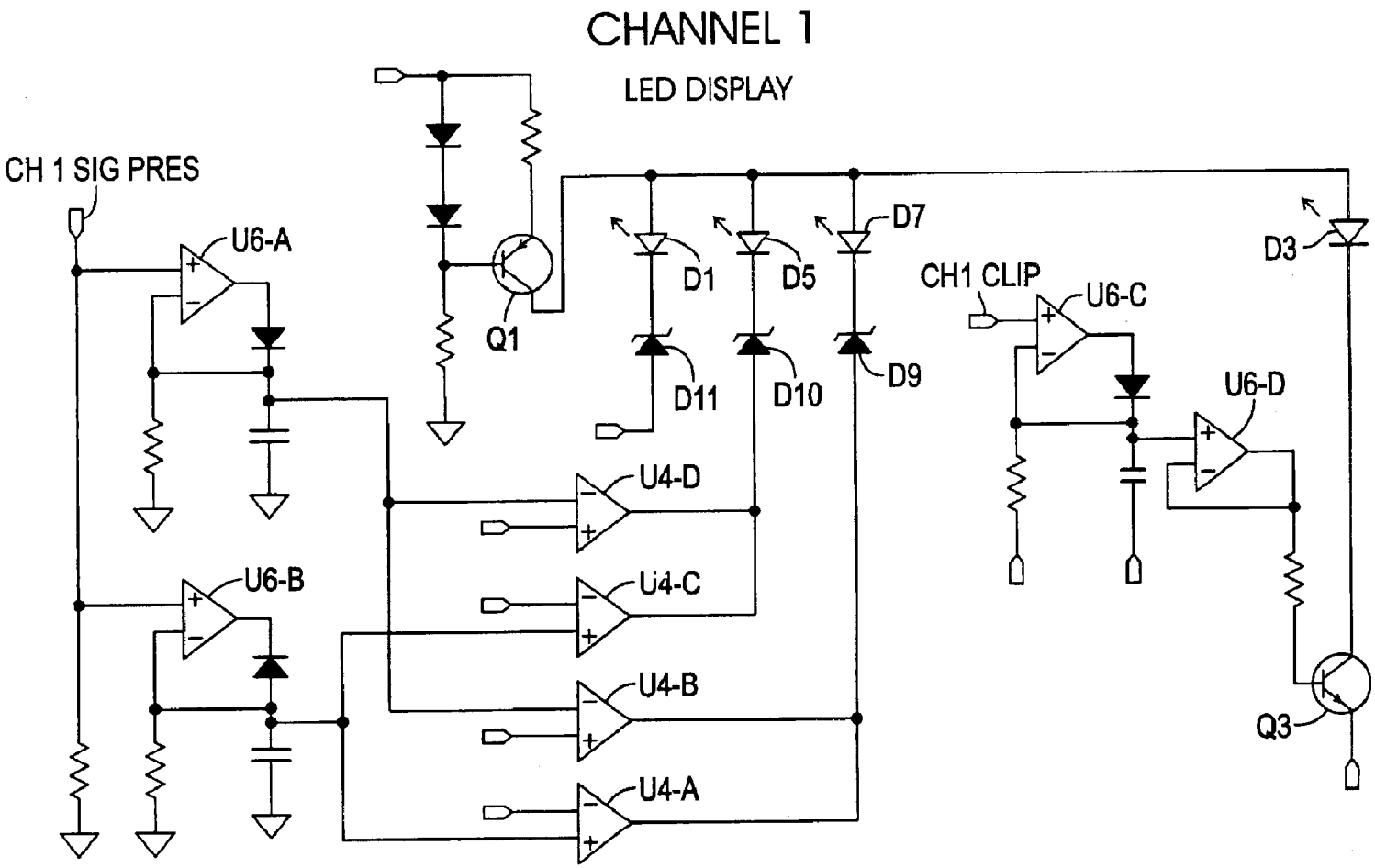
FIG. 5*b* is a schematic of the sensor circuitry, control logic circuitry and LED driver and display circuitry of a first channel of amplification of the apparatus of FIG. 5*d*.
Figure 5C:
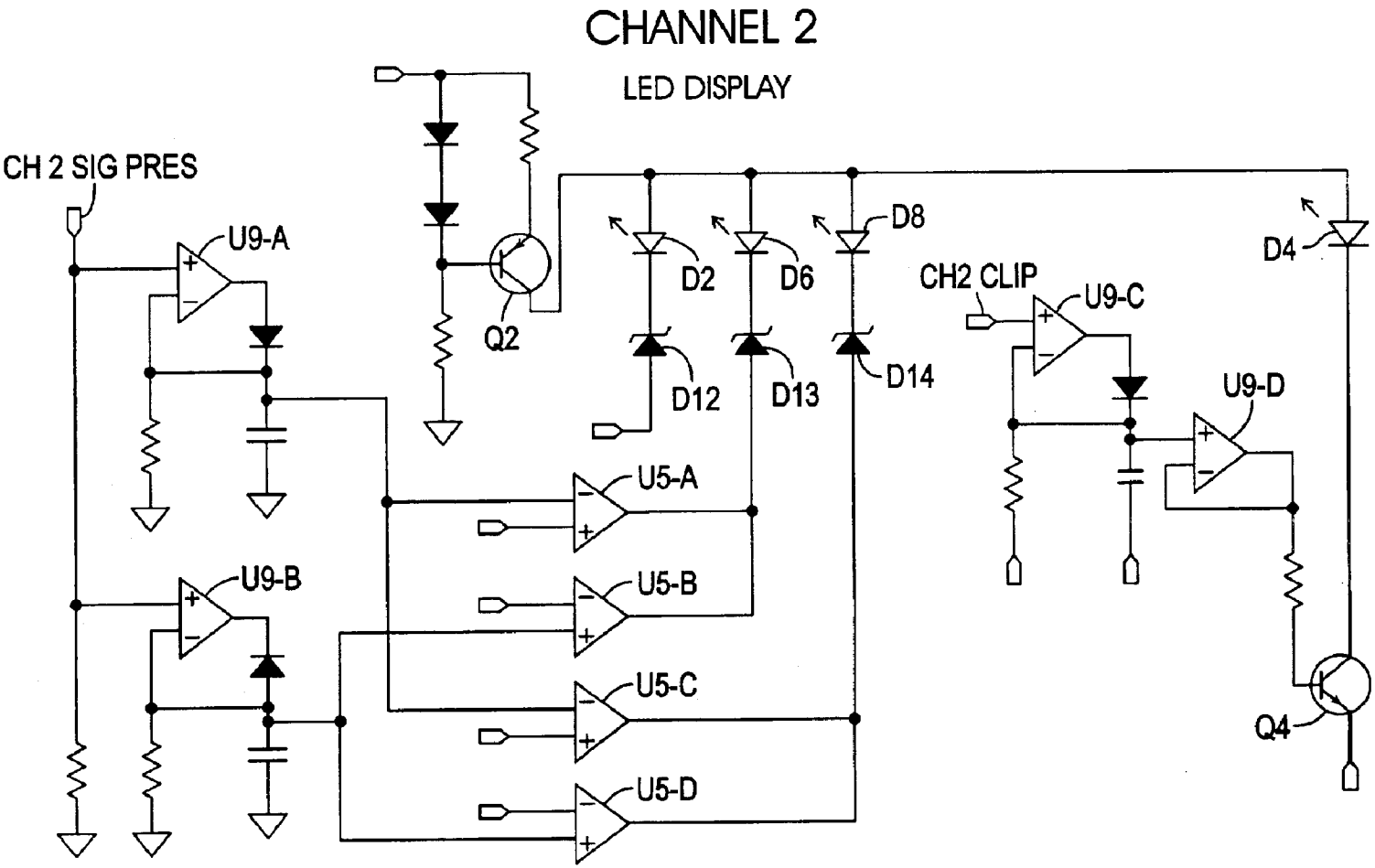
FIG. 5*c* is a schematic of the sensor circuitry, control logic circuitry and LED driver and display circuitry of a second channel of amplification of the apparatus of FIG. 5*d*.

One skilled in the art would recognize that the sensor circuit, control logic circuit and LED driver circuit need not comprise discrete circuits, but may be functionally integrated into each amplifier channel circuit. Referring now to FIGS. 5*a*, 5*b*, and 5*c*, a 30 VDC buffered power supply is shown having a (+) 15 VDC distribution and a (−) 15 VDC distribution. LEDs D1, D3, D5, and D7 form a Channel 1 LED display, wherein each LED emits a different color light. Correspondingly, LEDs D2, D4, D6, and D8 form a Channel 2 LED display, wherein each LED emits a different color light. LEDs D1–D8,each in parallel, receive power from and are in electronic communication across the (+) 15 VDC distribution and a (−) 15 VDC distribution. LEDs D1, D5, and D7 are in series with zener diodes D11, D10 and D9 respectively, and LEDs D2, D6, and D8 are in series with zener diodes D12, D13 and D14, respectively. When normal voltage is present on the (+) 15 VDC distribution, switch Q1 (Channel 1) and switch Q2 (Channel 2) close and complete the respective LED driver circuits. With normal voltage present on the (+) 15 VDC distribution and a (−) 15 VDC distribution, zener diodes D1 (Channel 1) and D12 (Channel 2) breakdown and allow illumination of LEDs D1 and D2 respectively. This LED emission corresponds to a "power on mode" for each channel.

Figure 5D:
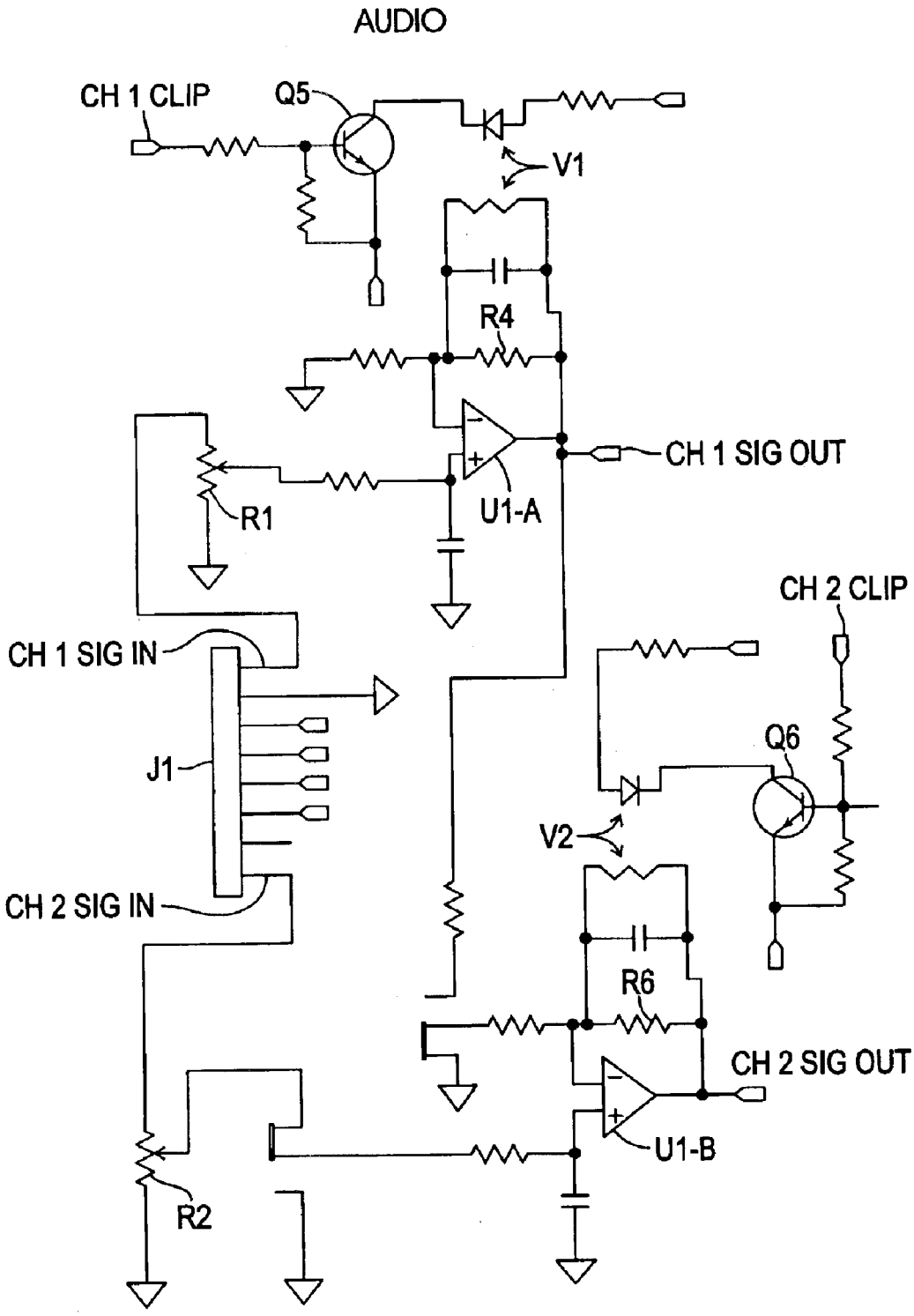
FIG. 5*d* is a schematic of the audio amplification circuitry and protective circuitry of a first and a second channel of amplification of one embodiment of the multicolor function indicator system of the present invention.
Figure 5E:
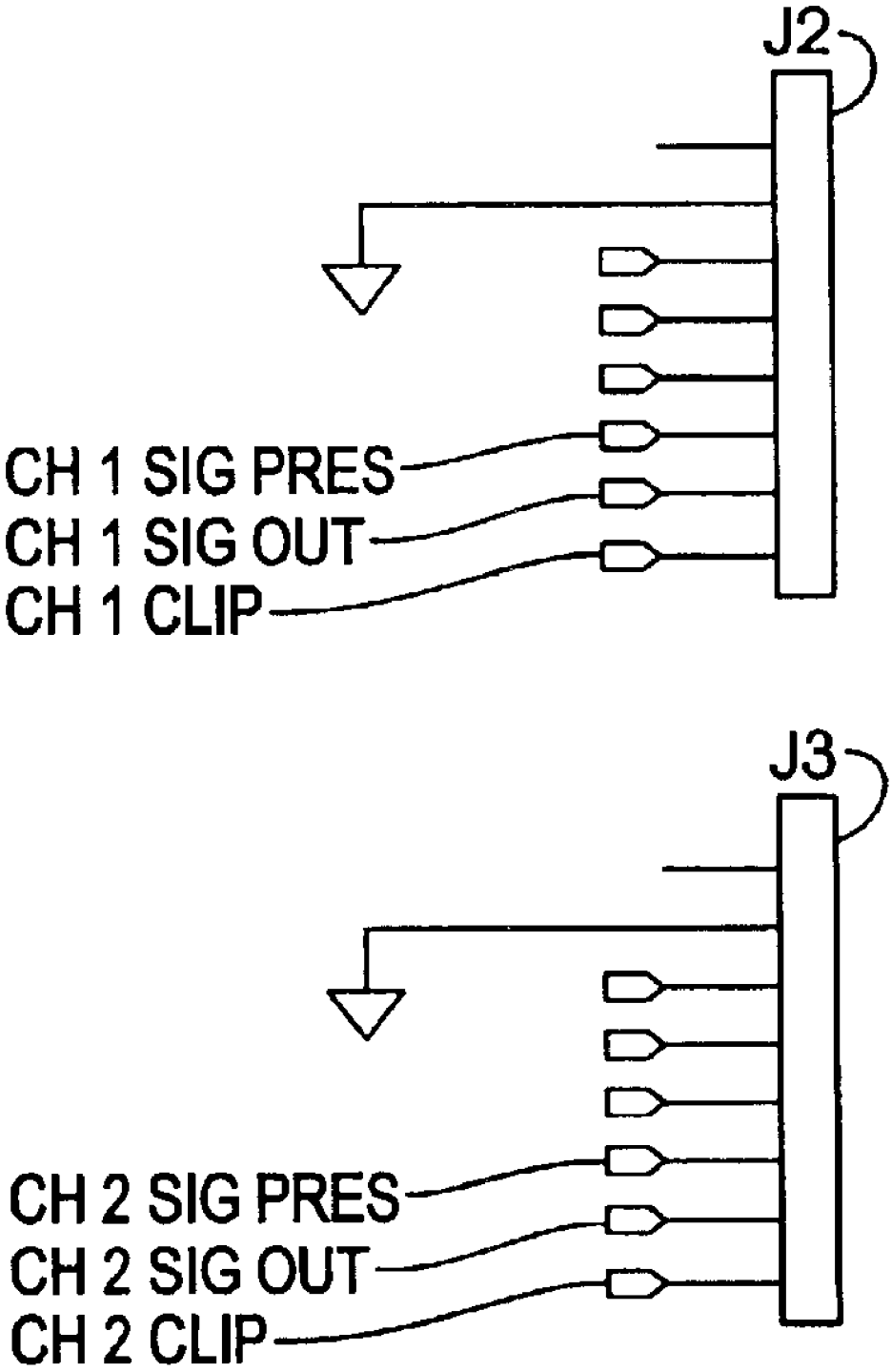
FIG. 5*e* is a schematic of the two pin connectors housed on the printed circuit board of the apparatus of FIG. 5*d*.

Referring now to FIGS. 5*d* and 5*e*, pin connector J1 provides input from the audio amplifier's printed circuit board and is shown providing a Channel 1 Input Signal CH 1 SIG IN and a Channel 2 Input Signal CH 2 SIG IN. Channel 1 audio amplifier U1-A and the Channel 2 audio amplifier U1-B receive their respective channel input signal and provide a Channel 1 Output Signal CH 1 SIG OUT and a Channel 2 Output Signal CH 2 SIG OUT at a fixed voltage gain. Variable resistors R1 and R2 provide for volume adjustments of their respective audio channels by allowing adjustment of the pick off voltages of the Channel 1 and Channel 2 Input Signals supplied to the Channel 1 and Channel 2 audio amplifiers U1-A and U1-B. Additionally, these same audio amplifiers provide Channel 1 Output Signal CH 1 SIG OUT and Channel 2 Output Signal CH 2 SIG OUT to pin connectors J2 (Channel 1) and J3 (Channel 2), respectively.

Referring now to FIGS. 5*b*, 5*c*, and 5*e*, pin connectors J2 (Channel 1) and J3 (Channel 2) provide Channel 1 Signal Present Signal CH 1 SIG PRES and Channel 2 Signal Present Signal CH 2 SIG PRES to Channel 1 operational amplifiers U6-A and U6-B peak detector circuits and to Channel 2 operational amplifiers U9-A and U9-B peak detector circuits, respectively. The voltage of the respective Channel Signal Present Signal is equal or proportional to the voltage of the Channel Output Signal. The peak detected outputs of the Channel 1 Signal Present Signal and of the Channel 2 Signal Present Signal are then provided to Channel 1 comparators U4-A, U4-B, U4-C and U4-D and to Channel 2 comparators U5-A, U5-B, U5-C and U5-D, respectively.

Referring to FIG. 5*b*, Channel 1 comparators are wired in parallel pairs (U4-D and U4-C forming a first pair, U4-A and U4-B forming a second pair), each comparator of each pair receiving a peak detected output of the Channel 1 Signal Present Signal. Referring to FIG. 5*c*, Channel 2 comparators are wired in parallel pairs (U5-A and U5-B forming a first pair, U5-C and U5-D forming a second pair), each comparators of each pair receiving a peak detected output of the Channel 2 Signal Present Signal. Referring now to FIGS. 5*b* and 5*c*, each channel's first pair of comparators are connected in series with a zener diode (D10 Channel 1 and D13 Channel 2) and with a LED which emits a yellow light (D5 Channel 1 and D6 Channel 2). Each channel's second pair of comparators are connected in series with a zener diode (D8 Channel 1 and D14 Channel 2) and with a LED which emits an orange light (D7 Channel 1 and D8 Channel 2).

Upon exceeding a first pre-selected voltage, each peak detected output of each Channel Signal Present Signal causes each of the first comparator pairs to alternately reverse output voltage. The reversal of output voltages provide biasing voltage sufficient for zener diodes D11 (Channel 1) and D12 (Channel 2) to breakdown. The circuit path is completed and LEDs D5 (Channel 1) and D6 (Channel 2) emission is provided. These LED emissions correspond to a "signal present mode" for each respective channel.

Referring to FIG. 5*d*, over a normal range of operation, Channel 1 audio operational amplifier U1-A and the Channel 2 audio operational amplifier U1-B receive their respective channel input signal and provide a Channel 1 Output Signal CH 1 SIG OUT and a Channel 2 Output Signal CH 2 SIG OUT at a fixed voltage gain. If operating at the upper regions of amplifier output, the amplifier is mildly overdriven. In that region an increase in the voltage of a channel input signal results in amplifier voltage gain that is no longer fixed. Voltage gain decreases as channel input signal voltage increases and non-linear distortion begins to occur. This region of operation is frequently termed self-induced clipping or clipping.

Referring now to FIGS. 5*b* and 5*c*, upon exceeding a second and higher pre-selected voltage corresponding to the onset of self-induced clipping, each peak detected output of each Channel Signal Present Signal causes, alternately, each of the second comparator pairs to reverse output voltage and provide biasing voltage sufficient for zener diodes D8 (Channel 1) and D14 (Channel 2) to breakdown. The circuit path is completed and LEDs D7 (Channel 1) and D8 (Channel 2) emission is provided. These LED emissions correspond to a "clipping mode" for each respective channel. An operator may recognize the visual signal and adjust the volume controls accordingly.

If the voltage of a channel input signal is further increased beyond the initial self-induced clipping region, the amplifier output signal voltage may be so high as to cause damage. This region of operation is frequently termed an overdriven condition. It is desirable for the circuit to have protective features to prevent such damage. It is also desirable to visually signal to the operator that a protective feature has been triggered.

Referring to FIG. 5*e*, pin connectors J2 (Channel 1) and J3 (Channel 2) provide Channel 1 Clip Signal CH 1 CLIP and Channel 2 Clip Signal CH 2 CLIP to Channel 1 and to Channel 2 protective circuits, respectively. The voltage of the each Channel Clip Signal is proportional to the voltage of the respective Channel Output Signal. Referring to FIG. 5*d*, Channel Clip Signals pick off voltages are supplied to Channel 1 and to Channel 2 protective switches Q5 and Q6, respectively. Each channel protective switches is wired in series with the LED portion of an electro-optical switch, V1 and V2 respectively. The optical switch portion of the respective electro-optical switch is wired in parallel with the channel gain control resistors R4 and R6, respectively, and wired in parallel with Channel 1 audio operational amplifier U1-A and the Channel 2 audio operational amplifier U1-B, respectively.

Upon either Channel Clip Signal pick off voltage exceeding a third preselected voltage corresponding to the onset of an overdriven condition, the respective channel protective switch Q5 (Channel 1) and Q6 (Channel 2) will close and complete a circuit for the LED portion of the respective channel electro-optical switch V2 (Channel 1) and V3

(Channel 2). The now emitting LED portion will trigger the respective optical switch, causing the switch to close and provide a protective short circuit around the a channel gain control resistor. This protective feature, when triggered, causes an automatic reduction in the respective channel audio operational amplifier gain.

Referring now to FIGS. 5*b* and 5*c*, LEDs D3 (Channel 1) and D4 (Channel 2) are wired in series with switches Q3 (Channel 1) and Q4 (Channel 2), respectively. Channel 1 Clip Signal CH 1 CLIP and Channel 2 Clip Signal CH 2 CLIP are provided to Channel 1 operational amplifier U6-C peak detector circuits and to Channel 2 operational amplifiers U9-C peak detector circuits, respectively. The peak detector outputs of Channel 1 Clip Signal and Channel 2 Clip Signal are the provided to Channel 1 comparator U6-D and to Channel 2 comparator U9-D, respectively.

Upon exceeding a fourth pre-selected voltage, each rectified Channel 1 Clip Signal and Channel 2 Clip Signal causes Channel 1 comparator U6-B and to Channel 2 comparator U9-C, respectively, to reverse output voltage and to provide biasing voltage sufficient for switches Q3 (Channel 1) and Q4 (Channel 2) to close. Upon closing, switches Q3 (Channel 1) and Q4 (Channel 2) provide a completed circuit path for LEDs D3 (Channel 1) and D4 (Channel 2). LEDs D3 and D4 emit a red light. These LED emissions correspond to a "protection mode" for each respective channel. An operator may recognize the visual signal and adjust the volume controls accordingly.

One skilled in the art would recognize that, in the above illustrated embodiment of the present invention, the sensing circuitry and the control logic circuitry are dispersed within the circuitry of each amplification channel. Referring now to FIG. 5*b*, one example of sensing circuitry of this embodiment is the peak detector formed by the component and wiring configuration comprising the U6-A operational amplifier and that amplifier's associated diode, resistor and capacitor. This peak detector, through the processes discussed above, senses the voltage of the Channel 1 Signal Present Signal and provides a peak detector output signal which is representative of the signal present mode of operation and is representative of the clipping mode of operation. In Channel 1, similar peak detectors are formed by each of the U6-B and the U6-C operational amplifiers and each amplifier's respective associated diode, resistor and capacitor. In the embodiment of FIG. 5*b*, the peak detector associated with the U6-B operational amplifier also senses the voltage of the Channel 1 Signal Present Signal and provides a peak detector output signal which is representative of the signal present mode of operation and is representative of the clipping mode of operation. However, the peak detector associated with the U6-C operational amplifier senses the voltage of the Channel 1 Clip Signal and provides a peak detector output signal which is representative of the protection mode of operation.

Another example of sensor circuitry of this embodiment is the diode and resistor circuitry providing a pick off voltage to the Q1 transistor switch. This sensor circuitry, through the processes discussed above, senses the voltage of the (+) 15 VDC distribution of the printed circuit board power supply and provides, as an input to the Q1 transistor switch, a pick off voltage which is representative of the power on mode of operation.

One example of control logic circuitry is embodied by the circuitry comprising the U4-D comparator wired in parallel with the U4-C comparator, each receiving input from a different peak detector circuit. This control logic circuitry, through the process discussed above, receives input signals from the two peak detectors associated with the U6-A and the U6-B operational amplifiers. The input signals, voltages correspond to the signal present mode of operation. As discussed above, if the input signals exceeds a first pre-selected value, the control logic circuitry comprising the U4-D and U4-C comparators controls the LED driver circuitry by providing biasing voltage sufficient for zener diode D10 to breakdown, thus completing a circuit path and energizing LED D5. LED D5's emission correspond to a "signal present mode" for Channel 1.

In Channel 1, similar control logic circuitry is formed by the circuitry comprising the U4-B comparator wired in parallel with the U4-A comparator, each receiving input from a different peak detector circuit. This control logic circuitry, through the process discussed above, also receives input signals from the two peak detectors associated with the U6-A and the U6-B operational amplifiers. The input signals' voltages correspond to the clipping mode of operation. As discussed above, if the input signals exceeds a second pre-selected value, the control logic circuitry comprising the U4-D and U4-C comparators controls the LED driver circuitry by providing biasing voltage sufficient for zener diodes D9 to breakdown, thus completing a circuit path and energizing LED D7. LED D7's emission correspond to a "clipping mode" for Channel 1.

Another example of control logic circuitry is formed by the circuitry comprising the Q3 transistor switch wired in series with the U6-D comparator and receiving input signals from the peak detectors associated with the U6-C. The input signal voltage corresponds to the protection mode of operation. As discussed above, if the input signals exceeds a fourth pre-selected value, the control logic circuitry comprising the Q3 transistor switch and U6-D comparator, controls the LED driver circuitry by closing the Q3 transistor switch, thus completing a circuit path and energizing LED D3. LED D3's emission correspond to a "protection mode" for Channel 1.

Yet another example of control logic circuitry is formed by the circuitry comprising the Q1 transistor switch receiving, as an input signal, a pick off voltage which is representative of the power on mode of operation. As discussed above, the Q1 transistor switch controls the LED driver circuitry by closing the Q1 transistor switch, thus completing a circuit path and energizing LED D1. LED D1's emission correspond to a "power on mode" for Channel 1.

In the embodiment of the invention shown in FIGS. 5*b*, 5*c* and 5*d*, the hierarchy of the mode of operation of each channel's audio amplifier in this embodiment starts with the power on mode of operation. The power on mode of operation must be achieved in order to progress to the signal present mode. Similarly the signal present mode must be present for clipping to occur. Finally, the clipping mode would precede any anticipated protection mode. Channel 1 and Channel 2 control logic circuitry operate the LED driver circuitry in the hierarchical order of the respective mode of operation. LEDs are energized in sequential order as the corresponding mode of operation occurs. As shown in this embodiment, an LED corresponding to a mode of operation remains energized even if the audio amplifier's mode of operation progresses to a hierarchically higher mode. The luminaire output for each mode of operation is then a different, but blended color of light determined by the color and intensity of the LED corresponding to the current mode of operation and by the color and intensity of the LEDs corresponding to each mode of operation that is of a lower hierarchical order. For example, the luminaire output of for the protection mode for this embodiment would be a blend of all four LEDs in the affected channel.

One skilled in the art would recognize that other embodiments are readily apparent wherein the energizing of an LED corresponding to a particular mode of operation caused any LEDs corresponding to a hierarchically lower mode of operation to de-energize. Still other alternative embodiments are readily apparent in which the modes of operation of the audio amplifier include non-hierarchical sensed modes of operation and correspondingly non-hierarchical control logic circuitry.

Although the multicolor indicator function system of the present invention has been disclosed in the context of a professional audio amplifier, it will be appreciated that it may be utilized in many other types of electronic equipment for monitoring and indicating many different selected operational modes or parameters.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A polychromatic light indicator system for monitoring a power amplifier disposed within a housing, said light indicator system comprising:

sensing circuitry for sensing different modes of operation of the amplifier;

a luminaire comprising:

a polychromatic light source for emitting output light of selectably different color;

a reflector assembly disposed adjacent to the light source and having a plurality of reflective surfaces for receiving and reflecting the output light emitted by the light source; and an indicator lens disposed adjacent to the reflector assembly for receiving and refracting the output light reflected by the reflector assembly such that the output light is displayed to an observer; and control logic circuitry for receiving input signals from the—sensing circuitry and for selectably controlling the polychromatic light source such that each different sensed mode of operation of the amplifier is indicated by a luminaire output light of a different color wherein the control logic circuitry further controls the polychromatic light source such that the color of the output light displayed is determined by a hierarchy of modes operation of the amplifier and wherein the different sensed modes of operation of the amplifier comprise:

a cower on mode;

a signal present mode;

a clipping mode; and a protection mode.

2. The system of claim 1, wherein polychromatic light source comprises a light emitting diode (LED) array.

3. The system of claim 2, wherein the LED array comprises at least one red LED, at least one green LED, at least one yellow LED and at least one orange LED.

4. The system of claim 1, said reflector assembly further comprising a diffuser box for receiving the reflected output light and diffusing the same.

5. The system of claim 1, wherein the indicator lens includes an inner lens surface and an outer lens surface, said inner lens surface proximal to the reflector assembly and said outer lens surface distal to the reflector assembly.

6. The system of claim 5, said indicator lens further comprising a lens material suitable for molding.

7. The system of claim 6, said lens material comprising an acrylic material.

8. The system of claim 6, wherein said amplifier is disposed within a housing comprising an exterior molded panel and wherein said indicator lens is integrally molded within said exterior molded panel.

9. The system of claim 5, said indicator lens further comprising opacity particles dispersed within the lens material for providing more even dispersion of output light across said outer lens surface.

10. The system of claim 5, said outer lens surface comprising a convex outer lens surface for magnifying the output light displayed to an observer.

11. The system of claim 5, said inner lens surface comprising a flat inner lens surface, said flat inner lens surface treated so as to provide more even dispersion of output light across said outer lens surface.

12. The system of claim 11, wherein said flat inner lens surface having a treatment comprising frosting or texturing.

13. The system of claim 1, said control logic circuitry further comprising a microprocessor.

14. A multicolor function indicator light system for an audio amplifier, comprising:

sensor circuitry for monitoring operation of the amplifier;

an indicator light device for emitting colored light outputs in each of a plurality of colors; and control logic circuitry for receiving input signals from the sensor circuitry and for controlling the indicator light device so that different sensed modes of operation of the amplifier are indicated by different colored light outputs of the indicator light device, the different sensed modes of operation of the amplifier including at least the following:

(1) power on mode;

(2) signal present mode; and (3) clipping mode; and (4) protection mode.

15. The system of claim 14, wherein the indicator light device comprises:

an LED array comprising at least one LED for emitting light in each of a plurality of colors;

an LED driver circuit in electrical communication with the control logic circuitry and each LED of the LED array, wherein the control logic circuitry electronically signals the LED driver circuit to selectively energize each LED of the LED array;

a reflector assembly comprising at least one reflective surface, said reflector assembly disposed so as to receive and reflect the colored light emitted by each LED; and an indicator lens disposed adjacent to the reflector assembly, said indicator lens disposed so as to receive the reflected light from the reflector assembly and to refract the same such that a colored light output is displayed to an observer.

16. The system of claim 15, wherein the LED array comprises at least one LED for emitting red light, at least one LED for emitting green light, and at least one LED for emitting yellow light.

17. The system of claim 15, said reflector assembly further comprising a diffuser box disposed so as to receive the reflected light from the at least one reflective surface and diffuse the same so as to provide to the indicator lens a colored light having a substantially uniform color and intensity.

18. A method of visually indicating the operational mode of an audio amplifier, said method comprising the steps of:

(a) providing a multicolor function indicator system electrically connected to an audio amplifier, said amplifier being disposed in an audio amplifier circuit;

(b) sensing the operational mode of the amplifier; and (c) displaying a colored light output corresponding to the sensed mode of operation, whereby the color of said colored light output is selected from a plurality of colors, each corresponding to a different mode of operation, and whereby the different sensed modes of operation of the amplifier include at least the following:

(1) power on mode;

(2) signal present mode;

(3) clipping mode; and (4) protection mode.

* * * * *